US009103310B2

(12) United States Patent
Wolff

(10) Patent No.: US 9,103,310 B2
(45) Date of Patent: Aug. 11, 2015

(54) FUEL INJECTOR

(75) Inventor: Guenter Wolff, Schwieberdingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 998 days.

(21) Appl. No.: 13/142,800

(22) PCT Filed: Nov. 27, 2009

(86) PCT No.: PCT/EP2009/065964
§ 371 (c)(1),
(2), (4) Date: Sep. 21, 2011

(87) PCT Pub. No.: WO2010/081583
PCT Pub. Date: Jul. 22, 2010

(65) Prior Publication Data

US 2012/0000995 A1 Jan. 5, 2012

(30) Foreign Application Priority Data

Jan. 13, 2009 (DE) ..... 10 2009 000 184

(51) Int. Cl.
*F02M 59/00* (2006.01)
*F02M 61/00* (2006.01)
*F02M 63/00* (2006.01)
*F02M 61/16* (2006.01)

(52) U.S. Cl.
CPC ..... *F02M 61/168* (2013.01); *F02M 2200/8084* (2013.01)

(58) Field of Classification Search
CPC ..... F02M 61/168; F02M 2200/8084
USPC ..... 239/569, 584, 585.1, 585.2, 585.3, 239/585.4, 585.5, 533.1, 533.2, 533.3, 239/533.4, 533.5, 533.6, 533.7, 533.8, 239/533.9, 533.11, 533.12; 123/299, 446, 123/447, 467, 468
See application file for complete search history.

(56) References Cited

U.S. PATENT DOCUMENTS 4,951,878 A * 8/1990 Casey et al. ..... 239/462
5,409,165 A * 4/1995 Carroll et al. ..... 239/88
5,769,391 A 6/1998 Noller et al.

(Continued)

FOREIGN PATENT DOCUMENTS

DE 19503821 8/1996
DE 10103932 8/2002
EP 1264984 12/2002
EP 1619383 1/2006

(Continued)

OTHER PUBLICATIONS

International Search Report, PCT International Patent Application No. PCT/EP2009/065964, dated Feb. 4, 2010.

*Primary Examiner* — Justin Jonaitis
(74) *Attorney, Agent, or Firm* — Kenyon & Kenyon LLP

(57) ABSTRACT

A fuel injector, in particular for the direct injection of fuel into the combustion chamber of a mixture-compressing, spark-ignited internal combustion engine, includes a functional part, which has at least one nozzle body, parts of an actuator, an axially movable valve closing body, which forms a sealing seat together with a valve seat surface, as well as a hydraulic extension part, which is fixedly and tightly connected to the functional part. The extension part is an interface between a connection-side inlet stub and the functional part. At least one of the frontal contact surfaces of inlet stub, functional part, and extension part, with which these components press against one another and are fixedly connected, is designed to be convexly curved.

10 Claims, 4 Drawing Sheets

(56) References Cited

U.S. PATENT DOCUMENTS

| | | | | |
|---|---|---|---|---|
| 6,390,393 | B1 * | 5/2002 | Bulgatz | 239/585.1 |
| 6,896,210 | B2 | 5/2005 | Reiter et al. | |
| 2002/0047054 | A1 * | 4/2002 | Dallmeyer et al. | 239/585.1 |

FOREIGN PATENT DOCUMENTS

| | | |
|---|---|---|
| EP | 1843038 | 10/2007 |
| JP | 2003-502577 | 1/2003 |
| JP | 2004-68600 | 3/2004 |

* cited by examiner

FUEL INJECTOR

FIELD OF THE INVENTION

The present invention is directed to a fuel injector.

BACKGROUND INFORMATION

In conventional electromagnetically operable fuel injectors for intake manifold injection, a valve tube is formed from three parts as the main body of the fuel injector. A core and a valve seat carrier are connected to one another in a hydraulically sealed way via a nonmagnetic interface, at least two joints and connection points being necessary.

A fuel injector, in which the number of the components of the valve tube is decreased, so that the number of the connection points and joints is also reduced, is described in German Patent Application No. DE 195 03 821 A1. The entire valve tube is manufactured from a magnetically conductive material, so that magnetically nonconductive interfaces may be dispensed with. This design of the housing is not suitable for many applications in the case of direct fuel injection, since it is too short with respect to the existing installation situation and may not be sufficiently sealed against the engine compartment in a receptacle hole of a cylinder head.

A fuel injector is described in German Patent Application No. DE 101 03 932 A1, which is suitable in particular for the direct injection of fuel directly into the combustion chamber of an internal combustion engine, usage particularly being possible in installation situations in which a very long receptacle hole for the fuel injector is provided in the cylinder head. The fuel injector includes a nozzle body, which forms a housing body with an external pole and a coil housing, a solenoid coil, which is electrically excitable via a line and a plug contact, and a central fuel supply. The electrical line and the central fuel supply are jointly situated in an adapter, which substantially lengthens the fuel injector, and which is pluggable onto an inlet-side end of the housing body and connectable thereto. The fixed connections of adapter and housing body are achieved by welding, the components to be connected abutting one another. In particular, in the case of great lengths of the adapter, the risk of a negative alignment error exists during the joining and laser welding if the planar surfaces are not exactly perpendicular to the component axis. Possible centering of the components to avoid such alignment errors may have the result that wedge-shaped gaps arise at the contact surfaces. This results in problems during welding or in excessive welding warpage because of an irregular gap over the circumference of the joint.

SUMMARY

An example fuel injector according to the present invention may have the advantage that a very good centering capability is ensured in a simple and cost-effective way even in the case of great valve lengths, as are required in particular with central installation in a cylinder head having a very long receptacle hole for the fuel injector, and the risk of a negative alignment error is minimized during joining and laser welding of hydraulic extension parts. Problems during welding or excessive welding warpage because of an irregular gap in the connection areas are therefore substantially prevented. The connection areas in the hydraulic connection are designed according to the present invention in such a way that at least one of the opposing front faces of the components to be connected is implemented as convexly curved, in particular spherically curved having a constant radius. The example embodiment according to the present invention results in substantially improved quality of the concentricity and prevents problems during installation in the cylinder head.

It may be particularly advantageous to provide a hydraulic extension part as an interface between a connection-side inlet stub and a functional part, which is designed having a convexly curved contact surface in each case in the two connection areas of extension part/inlet stub and extension part/functional part.

By forming convex and concave contact surfaces of inlet stub, extension part, and functional part, the surfaces interact like a ball-and-socket joint due to their complementary design.

A variant which is more cost-effective to manufacture provides that one of the contact surfaces per connection area has a conically beveled chamfer.

BRIEF DESCRIPTION OF THE DRAWINGS

Exemplary embodiments of the present invention are shown in the figures and are explained in greater detail below.

DETAILED DESCRIPTION OF EXAMPLE EMBODIMENTS

Figure 1:
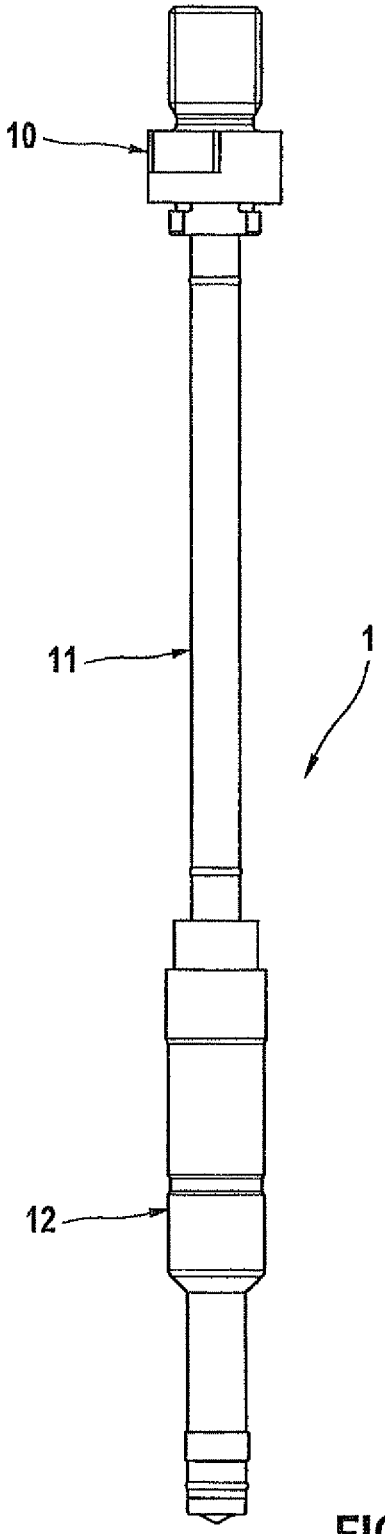
FIG. 1 shows a fuel injector having an extended hydraulic connection.

FIG. 1 shows an example of a fuel injector 1 in the form of a fuel injector 1 for fuel injector systems of mixture-compressing, spark-ignited internal combustion engines, which is distinguished in particular by an extended hydraulic connection. Fuel injector 1 is suitable in particular for the direct injection of fuel into a combustion chamber (not shown) of an internal combustion engine. In this construction, in which fuel injector 1 is particularly suitable for central installation in a comparatively long receptacle hole of a cylinder head (not shown), fuel injector 1 includes three main components for the hydraulic through-flow section, which together form a metallic valve interior tube: a hydraulic inlet stub 10, a hydraulic extension part 11, and a functional part 12, which also allows the fuel through-flow over its length.

Figure 2:
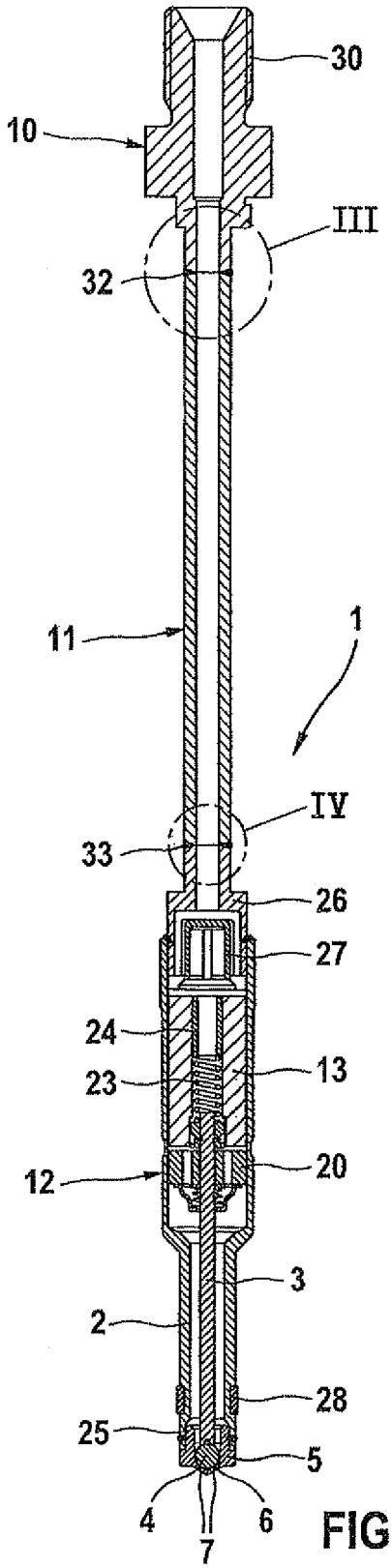
FIG. 2 shows a schematic section through a fuel injector according to FIG. 1, the views of FIGS. 1 and 2 only partially showing the valves (without electrical actuator, electrical connection, and plastic extrusion coating).

FIG. 2 shows a schematic section through partially shown fuel injector 1 according to FIG. 1, the views of FIGS. 1 and 2 each only showing fuel injector 1 with respect to its hydraulically relevant components, i.e., without electrical actuator, electrical connection, external magnetic component, and fuel extrusion coating. The main components in functional part 12 of fuel injector 1 are only described briefly hereafter.

Fuel injector 1 includes a nozzle body 2, in which a valve needle 3 is situated. Valve needle 3 is operationally linked to a valve closing body 4, which interacts with a valve seat surface 6 situated on a valve seat body 5 to form a sealing seat. Fuel injector 1 in the exemplary embodiment is an inwardly opening fuel injector 1, which has at least one discharge opening 7. Nozzle body 2 forms, through its elongated sleeve shape, the housing of a hydraulic cartridge for functional part 12. The electromagnetic circuit includes, inter alia, a solenoid coil (not shown), which is wound on a coil carrier, for example, which is in turn embedded in an external plastic part which may be pushed onto functional part 12. An internal pole 13 is introduced into the inner longitudinal opening of nozzle body 2.

An armature 20 is axially movably situated on valve needle 3. It is spaced apart by a pre-stroke gap in the unexcited state from an upper flange, which is fixedly connected via a weld seam to valve needle 3. A restoring spring 23 is supported on the upper flange, which is brought to pre-tension in the present construction of fuel injector 1 by a setting sleeve 24, the spring pre-tension of restoring spring 23 being set with the aid of setting sleeve 24.

Axially movable valve needle 3 is guided in an upper guide area and a lower guide area. The upper guiding is assumed by armature 20 in the inner opening of nozzle body 2, while the lower guiding is performed by valve closing body 4 in a guide element 25. Fuel ducts, through which fuel may flow up to injection openings 7, run in internal pole 13, in armature 20, and on guide element 25. The fuel supply into functional part 12 occurs via a stepped inflow part 26, which is fastened with the aid of welding on nozzle body 2, for example. For example, a filter element 27 may be situated in the interior of inflow part 26. Fuel injector 1 is sealed by a seal 28 on nozzle body 2 against a cylinder head (not shown).

A lower flange is also situated on valve needle 3, which delimits the axial movement path of armature 20 and is also fixedly connected to valve needle 3 via a weld seam. In this example embodiment, armature 20 may execute a relative movement in relation to valve needle 3, which is referred to as the armature clearance and which is used to avoid impacts of valve needle 3 on valve seat surface 6. In the idle state of fuel injector 1, valve needle 3 is acted upon by restoring spring 23 against its stroke direction in such a way that valve closing body 4 is held in sealing contact on valve seat surface 6. Upon excitation of solenoid coil 10, it builds up a magnetic field, which initially moves armature 20 in the stroke direction, the pre-stroke or the armature clearance being predefined by the pre-stroke gap. After passing through the pre-stroke, armature 20 is drawn against the force of restoring spring 23 to internal pole 13 of the magnetic circuit, armature 20 carrying along upper flange 21, whereby valve needle 3 is also carried along in the stroke direction. Valve closing body 4, which is connected to valve needle 3, lifts off of valve seat surface 6, and the fuel supplied via the fuel ducts is discharged through the at least one discharge opening 7.

As noted above, fuel injector 1 includes three main components for the hydraulic through-flow section. The two components hydraulic inlet stub 10 and hydraulic extension part 11 are installed upstream from functional part 12, which thus brings entire fuel injector 1 to a length which corresponds to two to three times the length of classical functional part 12, for example. Such a long design of a fuel injector 1 may be required in the case of central installation in a receptacle hole of a cylinder head for direct injection. Hydraulic inlet stub 10 has an inlet-side attachment section 30, which is used for the hydraulic connection of fuel injector 1 on an attachment stub of a fuel distributor line (not shown), a hose line, or a metal line. Attachment section 30 may be provided with a thread, for example. Hydraulic extension part 11 is a metallic tube, which ideally has a constant internal diameter and external diameter and may thus be manufactured very simply and cost-effectively. Extension part 11 is used to relay the fuel entering via inlet stub 10 to functional part 12. In addition, extension part 11 may also transmit axial forces to hold down fuel injector 1. Three components 10, 11, 12 of the hydraulic through-flow section are fixedly and tightly connected to one another in each case with the aid of a weld seam 32, 33.

Figure 3:
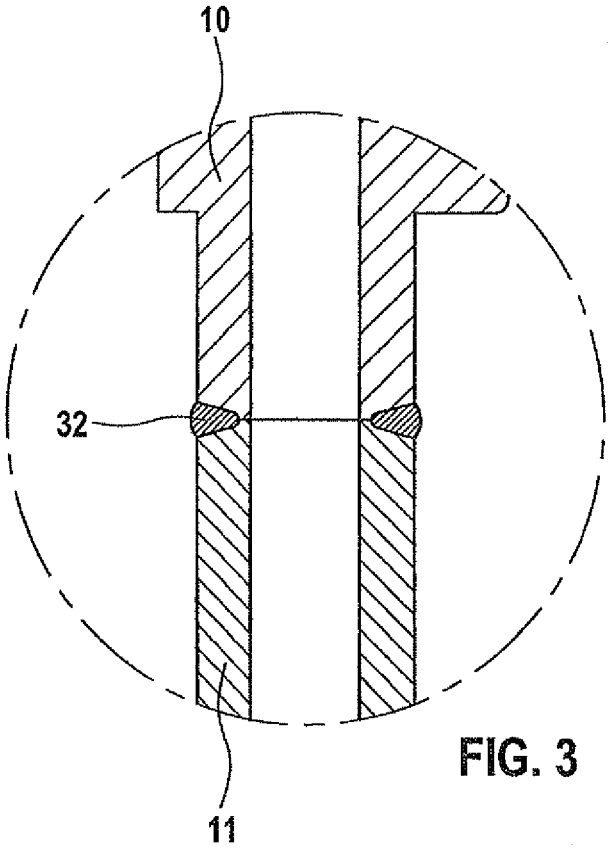
FIG. 3 shows an enlarged detail III of the fuel injector according to FIG. 2.
Figure 4:
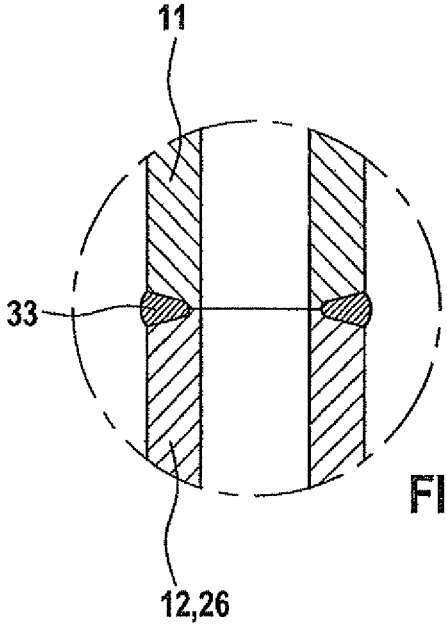
FIG. 4 shows an enlarged detail IV of the fuel injector according to FIG. 2.

An approach of a three-part valve internal tube is shown in FIGS. 2 through 4, in which components 10, 11, 12 have their planar front faces abutting one another flatly at the correspondingly welded bonds. FIG. 3 shows an enlarged detail III of the fuel injector according to FIG. 2 having the first connection area and weld seam 32; FIG. 4 shows an enlarged detail IV of the fuel injector according to FIG. 2 having the second connection area and weld seam 33. In particular in the case of great lengths of extension part 11, the risk exists during joining and laser welding of a negative alignment error, if the planar surfaces are not exactly perpendicular to the component axis. Possible centering of components 10, 11, 12 to avoid such alignment errors may have the result that wedge-shaped gaps arise at the contact surfaces. This results in problems during welding or in excessive welding warpage because of an irregular gap over the circumference of the joint.

In order to avoid these negative consequences of the above-described construction designs, the connection areas are embodied according to the present invention. At least one of each of the opposing front faces of the components of hydraulic inlet stub 10, hydraulic extension part 11, and functional part 12 is implemented as curved or spherical and having a constant radius.

Figure 5:
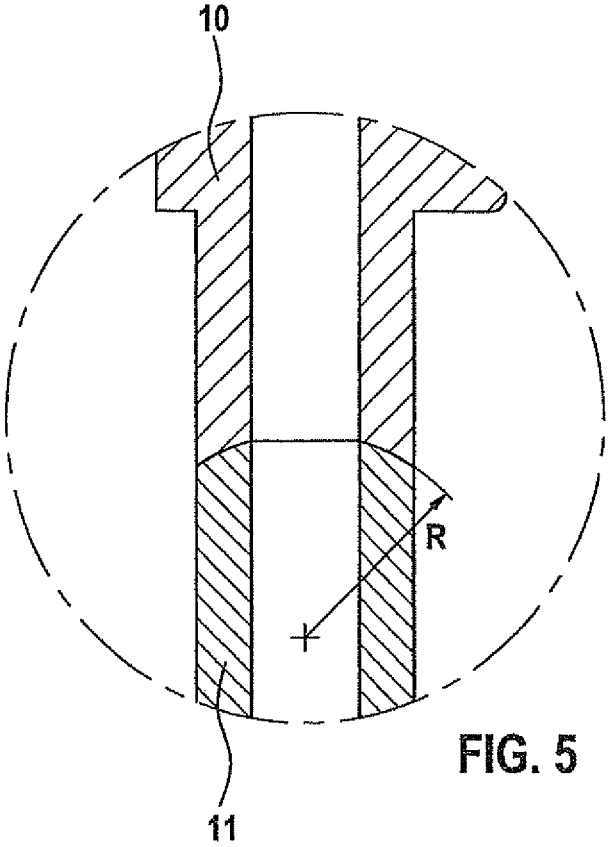
FIG. 5 shows a partial view of a first fuel injector according to the present invention in a detail similar to FIG. 3.
Figure 6:
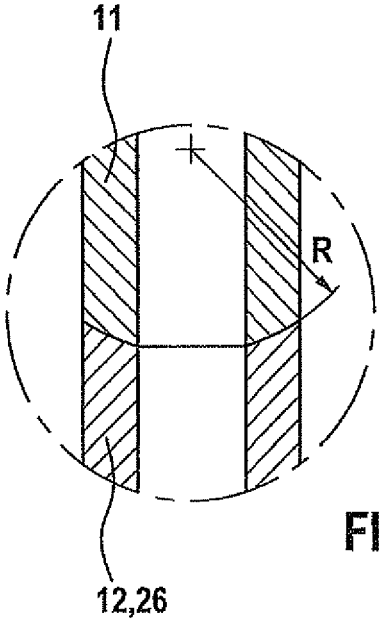
FIG. 6 shows a partial view of a first fuel injector according to the present invention in a detail similar to FIG. 4.

FIG. 5 shows a partial view of a first fuel injector 1 according to the present invention in a detail similar to FIG. 3, while FIG. 6 shows a partial view of a first fuel injector 1 according to the present invention in a detail similar to FIG. 4. Hydraulic inlet stub 10 is designed to have its contact surface facing toward extension part 11 be concave, in particular spherically concave; in contrast, the contact surface of extension part 11 facing toward inlet stub 10 is designed to be convex, in particular spherically convex. In this way, a connection area results in which the two corresponding contact surfaces press against one another like a ball-and-socket joint due to their complementary design and in which a weld seam 32 may subsequently be applied. Functional part 12 is designed to have its contact surface facing toward extension part 11 be spherically concave; in contrast, the contact surface of extension part 11 facing toward functional part 12 is again designed to be spherically convex. The corresponding contact surfaces also interact here like a ball-and-socket joint due to their complementary design.

Orientation of components 10, 11, 12 via a ball-and-socket joint is possible through this design according to the present invention of the contact surfaces of components 10, 11, 12, without an irregular gap arising in the connection area, which is accompanied by the above-described disadvantages during welding. During manufacturing, the assembly may be performed in such a way that the two parts of hydraulic inlet stub 10 and hydraulic extension part 11 are initially joined and welded to one another. Both components 10, 11 are oriented to one another and fixed in this oriented position, in which they are then welded, with the aid of a suitable device. The component thus resulting, made of components 10, 11, is then joined to functional part 12 and the components are centered to one another. The orientation of the two longitudinal axes of the components to one another is possible via the contact surfaces like a ball-and-socket joint, without a gap arising at the contact surfaces.

Figure 7:
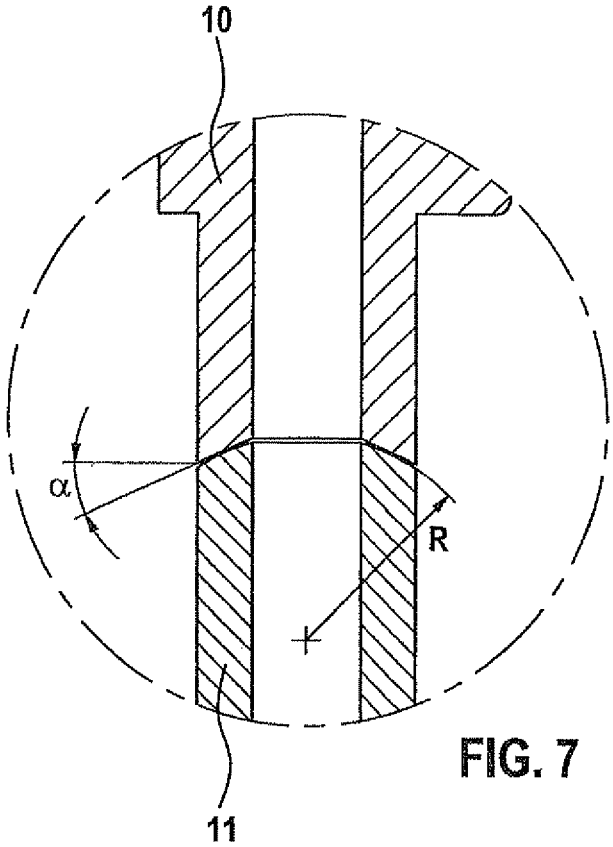
FIG. 7 shows a partial view of a second fuel injector according to the present invention in a detail similar to FIG. 3.
Figure 8:
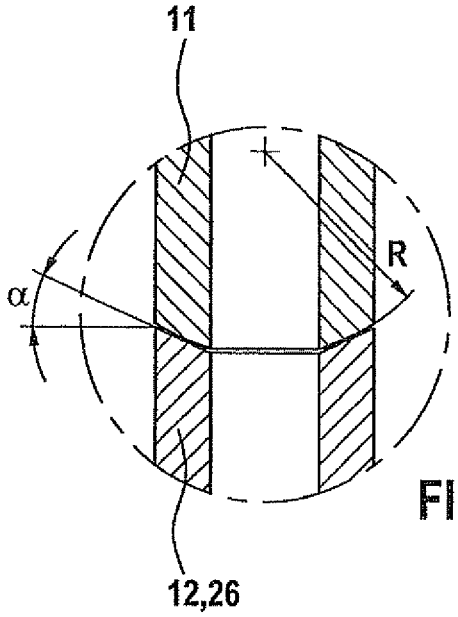
FIG. 8 shows a partial view of a second fuel injector according to the present invention in a detail similar to FIG. 4.

FIG. 7 shows a partial view of a second fuel injector 1 according to the present invention in a detail similar to FIG. 3, while FIG. 8 shows a partial view of a second fuel injector 1 according to the present invention in a detail similar to FIG. 4. Hydraulic inlet stub 10 is designed to be conical on its contact surface facing toward extension part 11, and conically expanding viewed in the flow direction; the contact surface of extension part 11 facing toward the conical contact surface, which expands in the flow direction, in contrast, is designed to be spherically convex. In this way, a connection area results, in which the two corresponding contact surfaces press against one another largely linearly and in which a weld seam 32 may subsequently be applied. The contact surface of functional part 12 facing toward extension part 11 is designed to be conical and conically tapered viewed in the flow direction; in contrast, the contact surface of extension part 11 facing toward functional part 12 is in turn designed to be spherically convex. The corresponding contact surfaces also extensively interact in a linear contact due to their design.

The particular conical contact surfaces on inlet stub 10 and on functional part 12 are identified by chamfer angle $\alpha$. The contact lines of both particular components 10, 11 and 11, 12 may be approximately in the middle of the wall thickness, for example. The radius of the convex contact, surfaces is to be selected in such a way that only minimally small gaps result on both sides of the contact lines, which have no interfering influence during welding. The desired centering effect is also provided with this approach. The conical chamfers on the contact surfaces of the components inlet stub 10 and functional part 12 may be manufactured particularly simply and cost-effectively.

Hydraulic extension part 11 may also be provided with conically tapering contact surfaces instead of the spherically convex contact surfaces, which then press against spherically convexly designed contact surfaces of the components to be connected, i.e., hydraulic inlet stub 10 and functional part 12, for example.

The present invention is not restricted to the illustrated exemplary embodiments and is also usable for other forms of fuel injectors 1.

What is claimed is:

1. A fuel injector for direct injection of fuel into a combustion chamber of a mixture-compressing, spark-ignited internal combustion engine, comprising:

a functional part which includes at least one nozzle body part of an actuator, and a valve closing body movable along a longitudinal axis which forms a sealing seat together with a valve seat surface; and a hydraulic extension part which is fixedly and tightly connected to the functional part via contact surfaces pressed against one another, wherein the contact surfaces are essentially perpendicular to the longitudinal axis;

wherein at least one of the contact surface of the functional part, and the contact surface of the extension part being convexly curved; and wherein a weld seam is applied in connection areas in which the at least one convexly curved contact surface is provided.

2. The fuel injector as recited in claim 1, wherein one of the contact surfaces of functional part and extension part is convexly curved and the other is conically beveled.

3. The fuel injector as recited in claim 1, wherein one of the contact surfaces of functional part and extension part is convexly curved and the other is designed to be concavely curved.

4. The fuel injector as recited in claim 1, wherein the hydraulic extension part is introduced as an interface between a connection-side inlet stub and the functional part.

5. The fuel injector as recited in claim 4, wherein at least one of the contact surfaces is convexly curved in each case in both a connection area of the extension part and the inlet stub, and a connection area of the extension part and the functional part.

6. The fuel injector as recited in claim 5, wherein both contact surfaces of the hydraulic extension part are convexly curved.

7. The fuel injector as recited in claim 5, wherein the contact surface of inlet stub and the contact surface of the functional part are one of conically beveled, or concavely curved.

8. The fuel injector as recited in claim 5, wherein the convexly curved contact surfaces of the inlet stub, the extension part, and the functional part can be received by a corresponding concavely curved contact surface due to a complementary design.

9. The fuel injector as recited in claim 1, wherein the convex curves of the contact surfaces are spherically convex.

10. The fuel injector as recited in claim 1, wherein the nozzle body forms a housing of a hydraulic cartridge for the functional part and the nozzle body is fixedly connected on an end facing toward the extension part to an inlet part, wherein the inlet part comprises a frontal contact surface, the frontal contact surface forming a connection area to the extension part.

* * * * *